United States Patent [19]

Frantz

[11] Patent Number: 4,958,989

[45] Date of Patent: Sep. 25, 1990

[54] DIGITAL FLUID CONTROL OF A PRESSURE COMPENSATED PUMP

[75] Inventor: William Frantz, Northridge, Calif.

[73] Assignee: Rockwell International Corporation, El Segundo, Calif.

[21] Appl. No.: 428,717

[22] Filed: Oct. 30, 1989

[51] Int. Cl.[5] ..... F04B 1/26

[52] U.S. Cl. ..... 417/222; 417/505

[58] Field of Search ..... 417/505, 506, 497, 218, 417/219, 220, 221, 222

[56] References Cited

U.S. PATENT DOCUMENTS

| | | | |
|---|---|---|---|
| Re. 31,711 | 10/1984 | Horiuchi | 417/222 |
| 2,999,482 | 9/1961 | Bower | 60/368 |
| 3,164,065 | 1/1965 | Frantz | 91/449 |
| 3,732,785 | 5/1973 | Boydell | 417/222 |
| 3,768,928 | 10/1973 | Miller et al. | 417/222 |

*Primary Examiner*—Leonard E. Smith
*Assistant Examiner*—David W. Scheuermann
*Attorney, Agent, or Firm*—Charles T. Silberberg; Lawrence N. Ginsberg

[57] ABSTRACT

An apparatus and method for selecting and controlling the output of a pressure compensated pump during operation is disclosed. The invention comprises a pressure compensated pump having a control inlet for the introduction of a digitally selected reference pressure. Means are provided for producing such a digitally selected reference pressure. Preferably, the means for producing this reference pressure includes a flow regulator for receiving fluid under pressure and establishing a constant pilot fluid flow; a plurality of conduits coupled in parallel to the output of the flow regulator between the flow regulator and a reservoir return flow; and, means individual to at least two of the conduits for controlling fluid flow in proportion to successive digital commands. The control inlet is also connected to the output of the flow regulator, the resulting reference pressure in the control inlet being generated by selected conduit flow areas characterized by the digital commands.

10 Claims, 1 Drawing Sheet

DIGITAL FLUID CONTROL OF A PRESSURE COMPENSATED PUMP

BACKGROUND OF THE INVENTION

1. Field of the Invention

This invention relates to the selection and control of the output of a pressure compensated pump during operation. More particularly, it relates to the introduction of a digitally selected reference pressure for the selection and control of the pump output.

2. Description of the Related Art

U.S. Pat. No. 2,999,482, entitled "Digital Fluid Control System" issued to J. L. Bower discloses a system in which a digitally coded signal is caused to provide a plurality of fluid signals individually proportional to the digits of such coded signal and means are provided for combining these fluid signals to provide an analog fluid signal indicative of the number represented by the original digitally coded signal.

The Bower device is limited in that it is sensitive to variation in load at the actuator, and thus cannot be accurate. Its end objective is a velocity of actuator stroking. System pressure will immediately jump to pump relief valve pressure when the actuator reaches the end of its stroke. As shown, the whole system is dedicated to one load (actuator). Duplication is required for each load.

Furthermore, successful application of the Bower device requires tremendous excess hydraulic power capability compared to the load, and only one load. This capability does not exist in aircraft.

U.S. Pat. No. 3,164,065, entitled "Incremental Digital Fluid Actuator", issued to the present inventor, discloses a position commanding/sensing device with the hydraulic equivalent of a potentiometer and closed loop on positon. An orifice is digitally selected and $\Delta P$ is thus generated. A contoured valve is connected to the actuator so that it generates an area proportional to the actuator stroke. Both $\Delta P$'s are matched and a servo-valve parts flow so that the actuator $\Delta P$ matches the selected $\Delta P$.

OBJECTS OF THE INVENTION

It is a principal object of the present invention to vary pump output pressure of a pressure compensating pump during operation.

Another object is to provide a reliable apparatus and method which can be used with existing pressure compensated pumps for selecting/controlling pump output pressure during operation.

It is another object to control a pressure compensated pump in accordance with a digitally coded signal.

A further object is to eliminate susceptibility of the pump control to electrical system characteristics.

Other objects, advantages and novel features of the present invention will become apparent from the following detailed description of the invention when considered in conjunction with the accompanying drawings.

SUMMARY OF THE INVENTION

The present invention is an apparatus and method for selecting and controlling the output of a pressure compensated pump during operation. In its broadest aspects, the invention comprises a pressure compensated pump having a control inlet for the introduction of a digitally selected reference pressure. Means are provided for producing such a digitally selected reference pressure. Preferably, the means for producing this reference pressure includes a flow regulator for receiving fluid under pressure and establishing a constant pilot fluid flow; a plurality of conduits coupled in parallel to the output of the flow regulator between the flow regulator and a reservoir return flow; and, means individual to at least two of the conduits for controlling fluid flow in proportion to successive digital commands. The control inlet is also connected to the output of the flow regulator, the resulting reference pressure in the control inlet being generated by selected conduit flow areas characterized by the digital commands.

The present invention may be used with existing pressure pumps to provide the advantage of selecting/controlling pump output pressure during operation. The present invention is particularly adaptable for aircraft use but not limited to such use. The technique is intended for use primarily with digital computers/signals, using codes such as binary, gray or combinations thereof. The advantages of this invention include the fact that it is compatible with a variety of codes. It can be used as an add-on or may be integral with conventional pressure compensated pumps. The proven operation of the pressure conpensated pump is not changed. On-Off signals are used for control, eliminating sensitivity to electrical system characteristics.

BRIEF DESCRIPTION OF THE DRAWINGS

The same elements or parts throughout the figures of the drawings are designated by the same reference characters.

DETAILED DESCRIPTION OF THE PREFERRED EMBODIMENT

Figure 1:
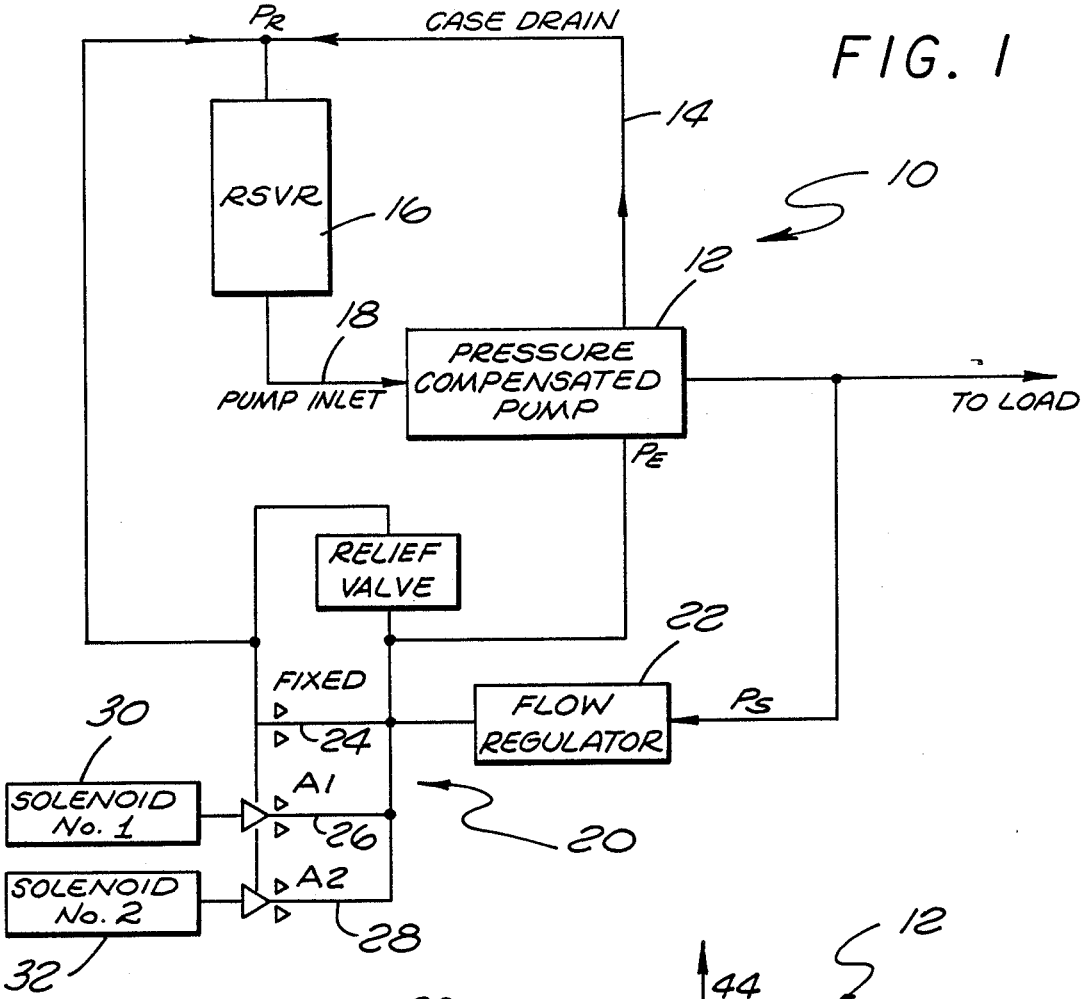
FIG. 1 is a diagrammatic illustration of the apparatus of the present invention.

Referring now to the drawings and the characters of reference marked thereon, FIG. 1 illustrates the system of the present invention, designated generally as 10.

System 10 includes a pressure compensated pump 12 which includes the provision for an externally supplied signal pressure, $P_E$. The output of such a pressure compensated pump 12 is typically used for aircraft applications. The pressure compensated pump 12 has a case drain flow 14 which is directed to a reservoir 16 and ultimately reintroduced into the pump 12 at inlet 18.

The present invention includes means for producing the digitally selected reference pressure, $P_E$, this means being designated generally as 20. $P_E$ producing means 20 includes a flow regulator 22 for receiving fluid under pressure, $P_S$ and establishing a constant pilot fluid flow which is independent of system pressure changes. A plurality of conduits 24, 26, 28 are coupled in parallel to the output of the flow regulator 22 between the flow regulator 22 and the reservoir 16. Means 30, 32 individual to at least two of the conduits 26, 28 are provided for controlling fluid flow in proportion to successive digital commands. Such means 30, 32 preferably comprise "normally closed" solenoids.

Figure 2:
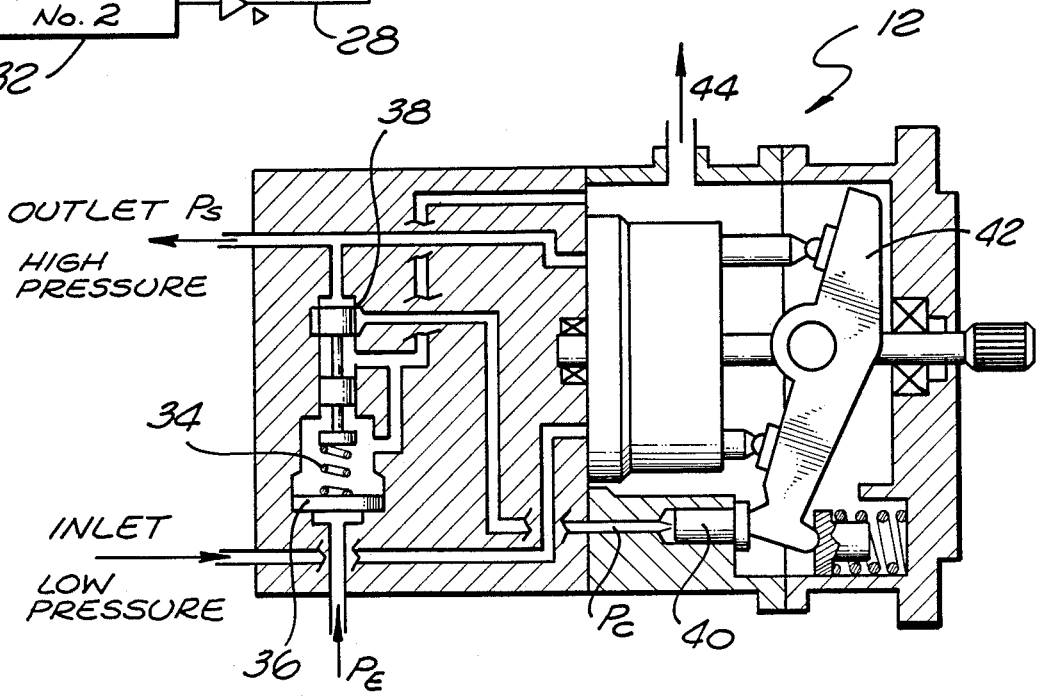
FIG. 2 is a schematic illustration of a conventional dual range pressure compensated pump which has been adapted to be used with the present invention.

Referring now to FIG. 2, a schematic illustration of a conventional dual range pressure compensated pump 12 which has been adapted is illustrated. A digitally selected reference pressure, $P_E$, (i.e. produced by means 20 of FIG. 1) is introduced to the pump 12 and loads a compensator valve spring 34, of a servovalve assembly. Spring 34 is connected to a compensating piston 36. A compensator valve 38 is used to control the yoke actuating piston 40 which strokes the pump yoke 42. The pump yoke 42 stroke establishes pump delivery to maintain the selected system output pressure.

In conventional operation, case drain flow 44 keeps the pump cool and reduces wear. However, with the present invention, the case drain flow provides the additional function of providing an external or reference pressure, $P_R$. The objective of such reference pressure is to insure that the device operates by pressure differentials rather than pressure levels so that the system is not sensitive to variations in pressure.

With the pump 12 illustrated in FIG. 2 the pump output pressure, $P_S$, is compared to the compensator valve spring 34, which, in this instance, has only two values as established by the two position compensation piston 36. Consider the signal pressure externally varied so that pump output pressure, $P_S$, is compared to the compensator spring 34 plus a selectable external signal pressure $P_E$. The force equilibrium at the compensator valve 38 can be written as follows:

$$(P_s)(A_{cv})=F_s+(P_R)(A_{cv})+(P_e-P_R)A_p$$

$$A_{cv}(P_s-P_R)=F_s+(P_E-P_R)A_p \quad (1)$$

$$P_s-P_R=F_s/A_{cv}+(P_E-P_R)A_p/A_{cv}$$

$$P_s=F_s/A_{cv}+(P_E-P_R)A_p/A_{cv}+P_R \quad (2)$$

Where $P_{s\,s}$=Outlet Pressure: psig $P_R$=Return Pressure: psig $F_s$=Spring Force: lbs $A_{Acv}$=Area, Compensator Valve: in$^2$ $P_E$=*External Signal Pressure: psig*

$A_p$=Area, Compensation Piston: in$^2$

Equation 2 demonstrates that pump output pressure, $P_s$, can be selected by varying $P_E$.

FIG. 2, for the purpose of illustration and not limitation, contains two input command solenoids 30, 32 which can allow selection of 4 pressure levels. Typically, 2 inputs will allow 4 levels; 3 inputs, 8 levels; 4 inputs, 16 pressure levels, etc.

Thus, for the purposes of analysis, the presently discussed embodiment of the invention contains two solenoids 30, 32 controlling flow through three orifices in parallel, and assembled as shown in FIG. 2.

The flow regulator 22 maintains a constant pilot flow:

$$q=K_1 \text{ (in}^3\text{/sec)}$$

$$q=K_1=C_d\Sigma A(2g\ \Delta P/\omega)^{\frac{1}{2}} \quad (3)$$

Where:

$\Delta P=P_E-P_R$ $\omega$=Fluid Density (lbs/in$^3$)

$C_d$=Orifice Coefficient (Dimensionless)

g=Gravitational Constant (in/sec$^2$)

$\Sigma A$=Summation of selected open orifice areas (in$^2$)

$\omega$ is essentially constant, $$\text{Then } K_1=\Sigma A(\Delta P)^{\frac{1}{2}}\times K_2,$$

$$\text{Where } K_2=C_d(2_g/\omega)^{\frac{1}{2}} \quad (4)$$

$$\text{Let } K_1/K_2=K_3=\Sigma A(\Delta P)^{\frac{1}{2}}$$

$$\text{Then } K_3=\Sigma A_1\Delta P_1{}^{\frac{1}{2}}=\Sigma A_2(\Delta P_2)^{\frac{1}{2}}$$

$$\Sigma A_1/\Sigma A_2=(\Delta P_2/\Delta P_1)^{\frac{1}{2}}$$

$$\Sigma A_1{}^2/\Sigma A_2{}^2\times\Delta P_1=\Delta P_2$$

or $$\Sigma A_1/(\Delta P_2/\Delta P_1)^{\frac{1}{2}}=\Sigma A_2$$

This may be rewritten to $$A_1/(\Delta P_2/\Delta P_1)^{\frac{1}{2}}=nA_1$$

Where n=area ratio of a selected area as compared to $A_1$, $$1.0/(\Delta P_2/\Delta P_1)^{\frac{1}{2}}=n$$

The desired area ratio n can be determined from $1.0/(\Delta P_2/\Delta P_1)^{\frac{1}{2}}=n$ Let $\Delta P_1$=8000 psid (the pump rated pressure), the area ratio (n) variation is as follows for various desired pump output pressures ($\Delta P_2$):

TABLE 1

| Desired $\Delta P_2$ | n |
|---|---|
| 8,000 | 1.0 |
| 6,000 | 1.155 |
| 4,000 | 1.414 |
| 2,000 | 2.0 |
| 1,000 | 2.829 |

A code has to be selected to approximate the above area ratios. For example, in a four solenoid system with the following chosen area ratios (n), the following area ratios (n) can be selected by energizing various combinations of solenoids. In the table below "E" indicates an energized, open position while "D" indicates a deenergized, closed position:

TABLE 2

| SOL. 1 n = 0.25 | SOL. 2 n = 0.5 | SOL. 3 n = 1.0 | SOL. 4 n = 1.0 | n |
|---|---|---|---|---|
| E | D | D | D | 0.25 |
| D | E | D | D | 0.50 |
| E | E | D | D | 0.75 |
| D | D | E | D | 1.0 |
| E | D | E | D | 1.25 |
| D | E | E | D | 1.5 |
| E | E | E | D | 1.75 |
| D | D | E | E | 2.00 |
| E | D | E | E | 2.25 |
| D | E | E | E | 2.50 |
| E | E | E | E | 2.75 |

Now, it is desired to determine the pressure that the pump would generate using these area ratios:

$$\Delta P_1/n^2=\Delta P_2$$

Using these area ratios pressure may be established:

TABLE 3

| n | ΔP2 | Percent of Pump Output |
|---|---|---|
| 1.0 | 8000 | 100% |
| 1.25 | 5118 | 64% |
| 1.50 | 3556 | 44.5% |
| 1.75 | 2612 | 32.7% |
| 2.00 | 2000 | 25% |
| 2.25 | 1580 | 20% |
| 2.50 | 1280 | 16% |

TABLE 3-continued

| n | ΔP2 | Percent of Pump Output |
|---|---|---|
| 2.75 | 1058 | 13.2% |

For most aircraft applications the useful pressure regime is between 2612 and 8000 psig. Thus, a two solenoid, one fixed orifice system is desired. Summarizing such a system,

TABLE 4

| SOL. 1 n = 0.25 | SOL. 2 n = 0.5 | Fixed Orifice n = 1.0 | ΣA = n | PRESSURE |
|---|---|---|---|---|
| D | D | Open | 1.0 | 8000 |
| E | D | Open | 1.25 | 5118 |
| D | E | Open | 1.5 | 3556 |
| E | E | Open | 1.75 | 2612 |

The results shown in Table 4 are based on a representative calculation directed toward a useful pressure selection range requiring a minimum of simple solenoids. This calculation is a sample of the technique of code selection, and is provided for illustration and not limitation. The desired pressure range, number and magnitude of pressure increments, are thus selectable to suit a particular application.

Obviously, many modifications and variations of the present invention are possible in light of the above teachings. It is, to be understood that within the scope of the appended the invention may be practiced otherwise than as specifically described.

What is claimed and desired to be secured by Letters Patent of the United States is:

1. An apparatus for selecting and controlling the output of a pressure compensated pump during operation, comprising:

(a) a pressure compensated pump having a servovalve assembly including a compensator valve spring and a compensating piston, said pressure compensating pump further having a control inlet in fluid communication with said inlet, said control inlet for introducing a digitally selected reference fluid pressure ($P_E$), said $P_E$ and said spring cooperating to establish a reference force, opposed by an output pressure of the pump, said reference force for positioning said piston within said servovalve assembly depending on the selected $P_E$, thus controlling the output of said pump; and (b) means for producing said $P_E$ in response to user selected digital commands.

2. The apparatus of claim 1 wherein said means for producing said digitally selected reference pressure ($P_E$) includes:

(a) a flow regulator for receiving fluid under pressure and establishing a constant pilot fluid flow;

(b) a plurality of conduits coupled in parallel to the output of said flow regulator between said flow regulator and a reservoir return flow; and (c) means individual to at least two of said conduits for controlling fluid flow in proportion to digital commands, said control inlet also being connected to said outlet of the flow regulator, the resulting reference pressure ($P_E$) in said control inlet being generated by selected conduit flow areas characterized by said digital commands.

3. The apparatus of claim 2 said wherein means individual to at least two of said conduits for controlling fluid flow includes a plurality of solenoids.

4. The apparatus of claim 2 further including a relief valve connected to said plurality of said conduits for protecting the apparatus against surges.

5. The apparatus of claim 2 wherein the output of said pressure compensated pump is used for controlling output pressure for aircraft applications, the number of solenoids being two.

6. The apparatus of claim 1 wherein said pressure compensated pump further includes a case drain for discharging heated cooling fluid from said pump.

7. The apparatus of claim 6 further including a fluid reservoir for receiving said cooling fluid from the case drain, said reservoir for allowing the fluid to cool prior to its reintroduction into the pump inlet.

8. An apparatus for selecting and controlling the output of a pressure compensated pump during operation, comprising;

(a) a pressure compensated pump having a servovalve assembly including a compensator valve spring and a compensating piston, said pressure compensating pump further having:

(i) a control inlet in fluid communication with said inlet, said control inlet for introducing a digitally selected reference fluid pressure ($P_E$), said $P_E$ and said spring cooperating to establish a reference force, opposed by an output pressure of the pump, said reference force for positioning said piston within said servovalve assembly depending on the selected $P_E$, thus controlling the output of said pump;

(ii) a case drain for discharging heated fluid from the pump;

(iii) a pump inlet for introduction of cooled fluid into the pump; and (iv) an outlet for providing high pressure fluid flow;

(b) a fluid reservoir for receiving said cooling fluid from the case drain, said reservoir for storing said cooling fluid prior to its reintroduction into the pump inlet; and (c) means for producing said $P_E$ in response to user selected digital commands.

9. The apparatus of claim 7 wherein said means for producing said digitally selected reference pressure includes:

(a) a flow regulator for receiving high pressure fluid flow from said outlet;

(b) a plurality of conduits coupled in parallel to an output of said flow regulator between said flow regulator and said fluid reservoir;

(c) means individual to at least two of said conduits for controlling fluid flow in proportion to successive digital commands, said control inlet also being connected to said outlet of the flow regulator, the resulting reference pressure ($P_E$) in said control inlet being generated by selected conduit flow areas characterized by said digital commands.

10. An apparatus for selecting and controlling the output of a pressure compensated pump during operation, comprising:

(a) a pressure compensated pump having a servovalve assembly including a compensator valve spring and a compensating piston, said pressure compensating pump further having:

(i) a control inlet in fluid communication with said inlet, said control inlet for introducing a digitally selected reference fluid pressure ($P_E$), said $P_E$ and said spring cooperating to establish a reference force, opposed by an output pressure of the pump, said reference force for positioning said piston within said servovalve assembly depending on the selected $P_E$, thus controlling the output of said pump;

(ii) a case drain for discharging heated fluid from the pump;

(iii) a pump inlet for introduction of cooled fluid into the pump; and (iv) an outlet for providing high pressure fluid flow;

(b) a fluid reservoir for receiving said cooling fluid and for storing said cooling fluid prior to its reintroduction into the pump inlet; and (c) means for producing said digitally selected reference pressure $P_E$ in response to user selected digital commands, including (i) a flow regulator for receiving high pressure flow from said outlet;

(ii) a plurality of conduits coupled parallel to an output of said flow regulator between said flow regulator and said fluid reservoir; and, (iii) means individual to at least two of said conduits for controlling fluid flow in proportion to successive digital commands, said control inlet also being connected to said outlet of the flow regulator, the resulting reference pressure ($P_E$) in said control inlet being generated by selected conduit flow areas characterized by said digital commands.

* * * * *